US005130497A

United States Patent [19]

Yoshikawa

[11] Patent Number: 5,130,497

[45] Date of Patent: Jul. 14, 1992

[54] INSULATING SPACER DISPOSED BETWEEN TWO MEMBERS DIFFERING IN ELECTRICAL POTENTIAL

[75] Inventor: Toru Yoshikawa, Hyogo, Japan

[73] Assignee: Mitsubishi Denki K.K., Tokyo, Japan

[21] Appl. No.: 710,258

[22] Filed: Jun. 4, 1991

Related U.S. Application Data

[63] Continuation of Ser. No. 531,427, May 31, 1990, abandoned.

[30] Foreign Application Priority Data

Jun. 21, 1989 [JP] Japan ..... 1-72582[U]

[51] Int. Cl.[5] ..... H01B 17/54

[52] U.S. Cl. ..... 174/137 R; 174/28; 174/29

[58] Field of Search ..... 174/27, 28, 29, 30, 174/68.1, 99 R, 99 B, 137 R

[56] References Cited

U.S. PATENT DOCUMENTS 3,496,281 2/1970 McMahon ..... 174/29

FOREIGN PATENT DOCUMENTS 54-148290 11/1979 Japan ..... 174/28

1068970 5/1967 United Kingdom ..... 174/28

*Primary Examiner*—Leo P. Picard

*Assistant Examiner*—Trinidad Korka

*Attorney, Agent, or Firm*—Sughrue, Mion, Zinn, Macpeak & Seas

[57] ABSTRACT

An insulating spacer comprises a plurality of unit spacers each of which has a hollow portion. The unit spacers are disposed between two members, such as electrodes, so that side walls of peripheral portions of the unit spacers are not aligned on a plane between the two members. There is no possibility that the space between the two members may be filled, for the most part, with insulating solid material; and a narrow gap may be present at the remaining minor part of the space. Therefore, there is no possibility of a local concentration of electric field between the two members.

6 Claims, 2 Drawing Sheets

INSULATING SPACER DISPOSED BETWEEN TWO MEMBERS DIFFERING IN ELECTRICAL POTENTIAL

This is a continuation of application Ser. No. 07/531,427 filed May 31, 1990 abandoned.

BACKGROUND OF THE INVENTION

1. Field of the Invention

This invention relates to an insulating spacer which is disposed between two members, such as electrodes, differing in electric potential in an electric apparatus, equipment, etc., to maintain an insulation distance between the two members.

2. Description of the Prior Art

FIG. 1 shows a sectional view of an insulating spacer according to the prior art. In the figure, reference numbers 1 and 2 denote a higher- and a lower-potential electrode, as two members differing in electric potential, and reference number 3 denotes platelike insulating barriers disposed between the electrodes 1 and 2 to prevent flashover between the electrodes. Reference number 4 denotes unit spacers made of an insulating solid material and having a bar shape with a tetragonal cross section, three such unit spacers being disposed between the higher- and lower-potential electrodes 1 and 2 to maintain an insulation distance between the electrodes and to clamp each of the insulating barriers 3 between the unit spacers 4, thereby maintaining the barriers in position.

The unit spacers 4 and insulating barriers 3 in practical use in an electric apparatus (not shown) or the like lack uniformity in their dimensions or have irregularities in their surfaces. Therefore, it is not always the case that the space between the electrodes 1 and 2, in which the unit spacers 4 are disposed, is filled completely with the insulating solid material as shown in FIG. 1. Namely, a gap 5 may in some cases be generated in the space, as for instance illustrated in FIG. 2. The gap 5 is filled with an ambient insulating medium such as a gas (air, sulfur hexafluoride, etc.) and an insulating oil (neither shown). Assuming that the specific dielectric constant of the insulating medium in the gap 5 is $\epsilon_2$, the specific dielectric constants of the insulating barriers 3 and the unit spacers 4 are equally $\epsilon_2$, the length of the gap 5 generated in the space between the electrodes 1 and 2 is $d_1$, while the total dimension of solid insulator portions is $d_2$, and the potential difference between the electrodes 1 and 2 is V, then the electric field strength Eg in the gap 5 is $$Eg = \frac{\epsilon_2 V}{\epsilon_2 d_1 + \epsilon_1 d_2} \quad (1)$$

On the other hand, the average electric field strength $E_0$ between the electrodes 1 and 2 is $$E_0 = \frac{V}{d_1 + d_2} \quad (2)$$

In general, an insulating solid material (inclusive of one which is impregnated with an insulating medium) in most cases has a higher specific dielectric constant than that of an insulating medium. By way of example, here, a case where $\epsilon_1 = 1$ and $\epsilon_2 = 3$ will be dealt with. When $d_1/d_2$ is varied, the ratio $Eg/E_0$ calculated from the equations (1) and (2) and taken as field concentration factor is varied as represented by the graph shown in FIG. 3. When the length $d_1$ of the gap 5 is small, the field concentration factor is 3 at maximum, that is, the field strength Eg in the gap 5 reaches 3 times the average field strength $E_0$. Thus, the portion of the gap 5 is exposed to very severe conditions on an insulation basis and, if Eg exceeds the dielectric strength of the insulating medium in that portion, a partial discharge might result. Therefore, careful consideration should be given to the field strength Eg in the gap 5 in designing the electric apparatus. While the above description has been based on the case of $\epsilon_2/\epsilon_1 = 3$, the field concentration factor $Eg/E_0$ will be further greater where the ratio $\epsilon_2/\epsilon_1$ is more than 3, so that special care should be taken of selection of the combination of the insulating medium with the solid insulating material.

The conventional insulating spacers, constructed as above, have had the possibility of a gap being generated to cause a local concentration of electric field on the gap. The conventional insulating spacers have therefore been limited in selection of the insulating solid material, constituting the insulating spacers, and the material for the insulating medium surrounding the spacers. In some cases, it has been necessary to take such countermeasure as enlarging the distance between the electrodes or the like members to lower the average field strength therebetween.

SUMMARY OF THE INVENTION

This invention contemplates overcoming the abovementioned drawbacks of the prior art.

It is accordingly an object of this invention to provide an insulating spacer which does not cause a local concentration of electric field.

In order to attain the above object, an insulating spacer according to this invention comprises a plurality of unit spacers which each has a hollow portion and a peripheral portion surrounding the hollow portion, the unit spacers being disposed between two members differing in potential so that side walls of the peripheral portions of the unit spacers are staggered in zigzag and not aligned on a straight line between the two members.

The above and other objects and novel features of this invention will be more fully understood from the following detailed description, taken in conjunction with the accompanying drawings, which are for illustration only and are not intended for limiting the scope of this invention.

DETAILED DESCRIPTION OF THE PREFERRED EMBODIMENTS

Figure 1:
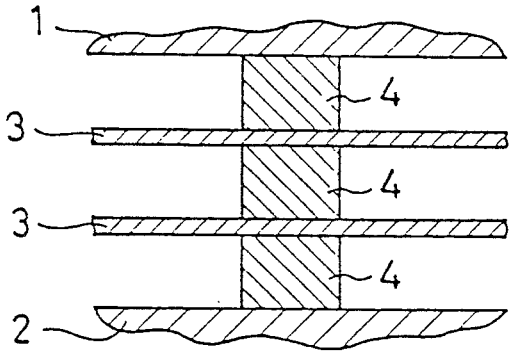
FIG. 1 (PRIOR ART)
FIGS. 1 and 2 are each a sectional view of two members differing in electrical potential and separated by an insulating spacer according to the prior art.
Figure 2:
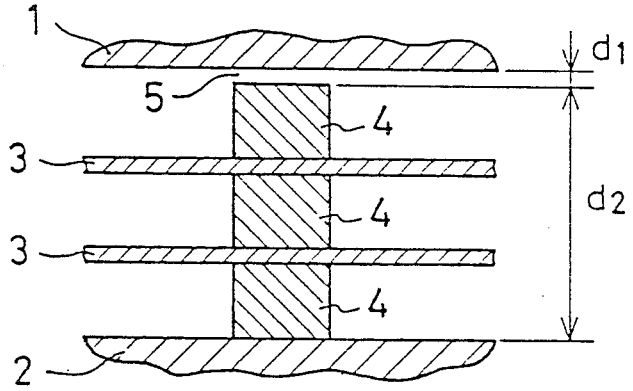
FIG. 2 (PRIOR ART)
Figure 4:
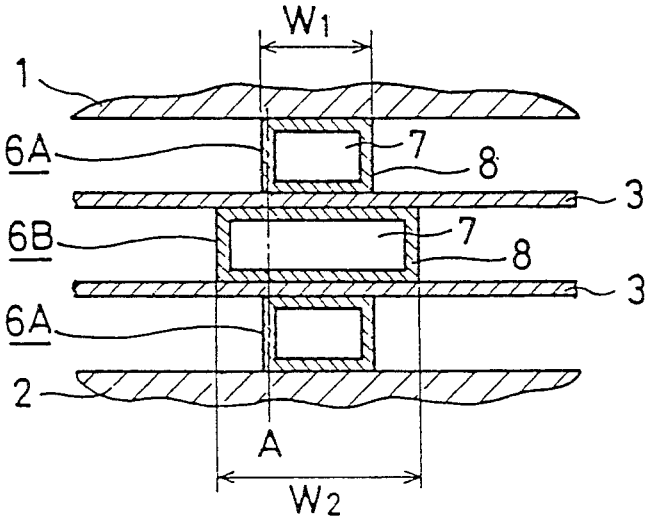
FIG. 4 is a sectional view of two members differing in electrical potential and separated by an insulating spacer according to one embodiment of this invention.

FIG. 4 shows a sectional view of two members differing in electrical potential and separated by an insulating spacer according to one embodiment of this invention. In the figure, reference numbers 1 to 3 denote higher- and lower-potential electrodes and an insulating barrier, respectively, similar to those shown in FIG. 1. Reference characters 6A and 6B each denotes a unit spacer formed of an insulating solid material such as a fibrous material, a ceramic, a resin, etc. Each of the unit spacers has a hollow shape, namely, a tubular shape with tetragonal cross section, comprising a hollow portion 7 and a peripheral portion 8 surrounding the hollow portion 7. The hollow portion 7 is filled with an ambient insulating medium, for instance, a gas or an insulating oil (neither shown). In the same manner as in FIG. 1, three unit spacers are disposed between the higher- and lower-potential electrodes 1 and 2 to maintain an insulation distance between the two electrodes and to clamp each insulating barrier 3 between the unit spacers 6A and 6B. The width $W_1$ of the unit spacer 6A is smaller than the width $W_2$ of the unit spacer 6B, and the width of the hollow portion 7 of the unit spacer 6A is smaller accordingly. The three unit spacers 6A and 6B are so disposed that side walls of the peripheral portions 8 thereof are staggered in zigzag and not aligned on a straight line, in the vertical direction in the figure.

Figure 3:
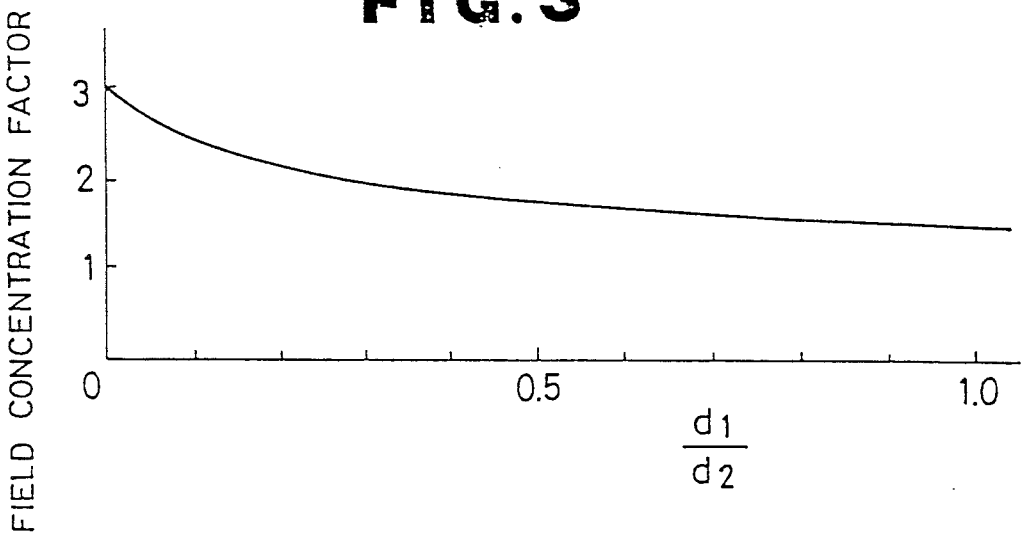
FIG. 3 is a graph representing the field concentration factor in the condition of FIG. 2.

Assuming a rectilinear path extending downward in the figure from an arbitrary point in the higher-potential electrode 1, then the assumed path cannot be filled up with the insulating solid material only, and inevitably involves at least one interval in which an insulating medium such as a gas, an insulating oil, etc., is present. Therefore, even if a narrow gap (not shown) is newly generated at a point on the rectilinear path assumed, a local concentration of electric field would never occur at that point. Referring to the rectilinear path represented by dash-and-dot line A, for instance, about one-third of the distance between the higher- and lower-potential electrodes 1 and 2 is constituted of the hollow portion 7. With $d_1/d_2=0.5$ in FIG. 3, therefore, the field concentration factor for this case is about 1.8. Namely, the presence of the hollow portion 7 prevents the ratio $d_1/d_2$ from being reduced to a value approximate to 0, and, accordingly, the field concentration factor is moderated as compared with those in the prior art. A construction in which the central unit spacer 6B is smaller in width than the other unit spacers 6A, contrary to the figure, also has the same effect.

Figure 5:
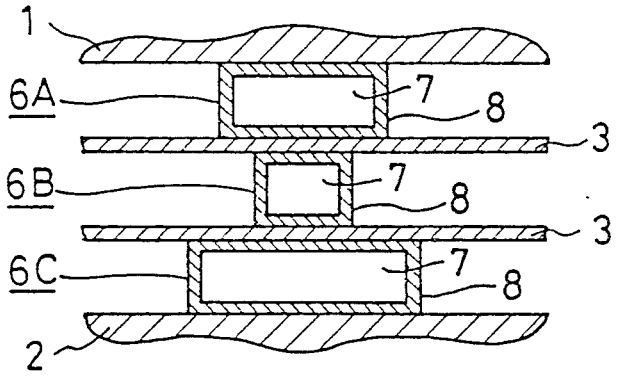
FIG. 5 is a sectional view of two members differing in electrical potential and separated by an insulating spacer according to another embodiment of this invention.

FIG. 5 shows a sectional view of two members differing in electrical potential and separated by an insulating spacer according to another embodiment of this invention, illustrating the case of using three kinds of unit spacers 6A, 6B and 6C differing in width. In this case, a further reduction in the field concentration factor is achievable, as compared with the case shown in FIG. 4.

Figure 6:
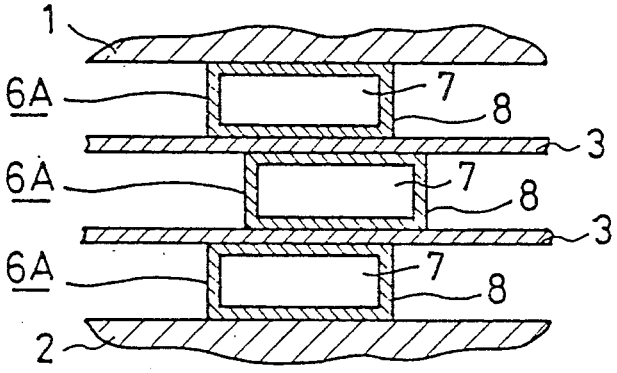
FIG. 6 is a sectional view of two members differing in electrical potential and separated by an insulating spacer according to a further embodiment of this invention.
Figure 1:
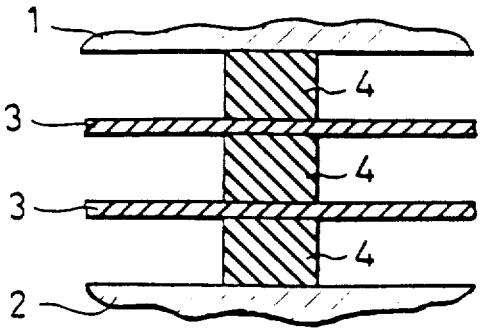
FIG. 1 (PRIOR ART)
Figure 2:
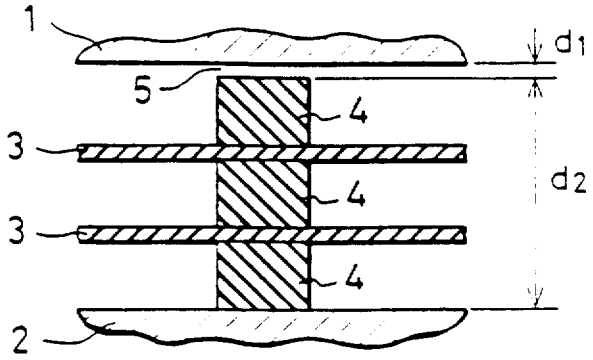
FIG. 2 (PRIOR ART)
Figure 3:
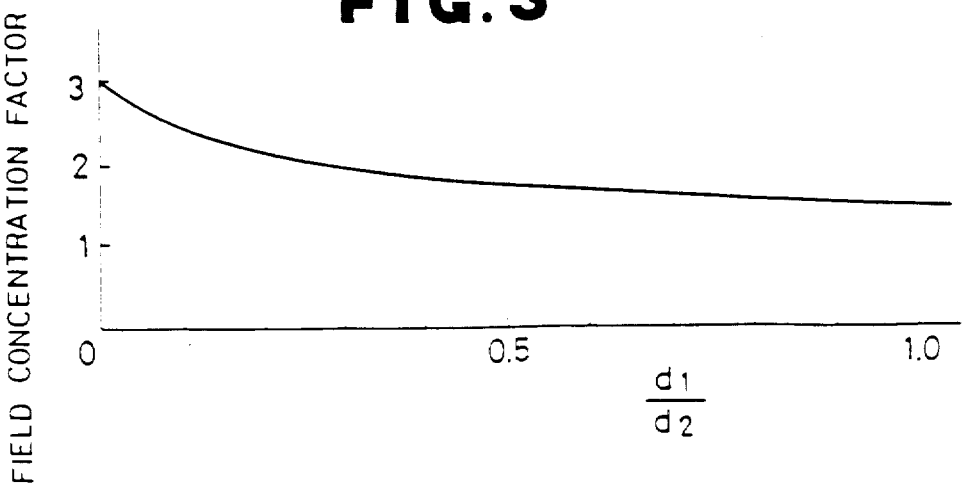
Figure 4:
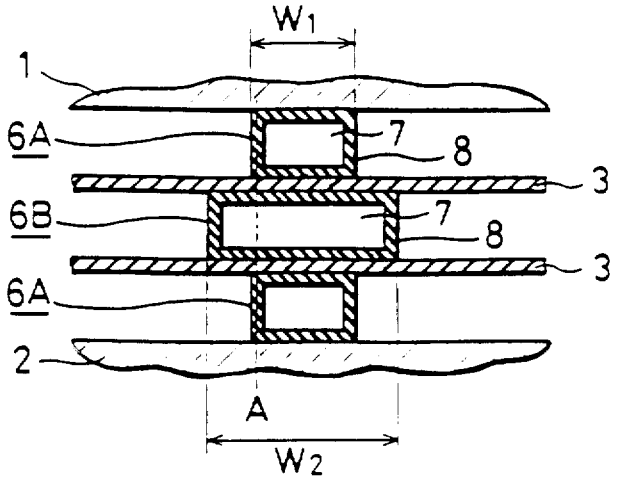
Figure 5:
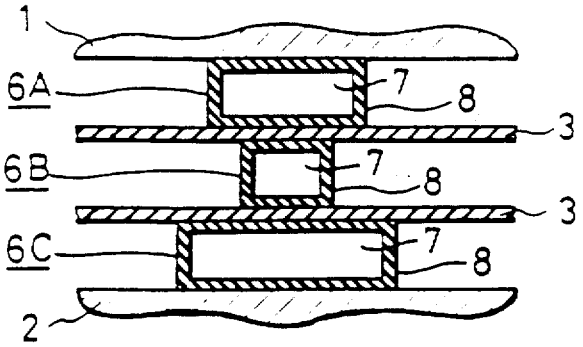
Figure 6:
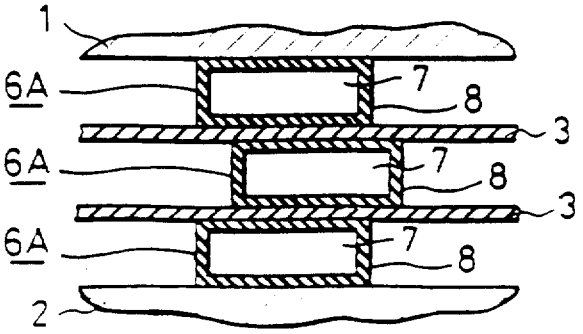

FIG. 6 shows a sectional view of two members differing in electrical potential and separated by an insulating spacer according to a further embodiment of this invention, illustrating the case of using one kind of unit spacers 6A. With the unit spacers 6A alternately staggered, horizontally in the figure, the same effect as in FIG. 4 is produced.

As has been described hereinabove, according to this invention the unit spacers are each made in a hollow form and are so staggered that the side walls of the peripheral portions of the unit spacers are not aligned on a plane. The construction precludes the possibility that the space between two members such as electrodes may be filled, for the most part, with insulating solid material while a narrow gap may be present at the remaining minor part of the space. According to this invention, therefore, there is obtained the effect of preventing a local concentration of electric field.

What is claimed is:

1. Two members differing in electrical potential and an insulating spacer for holding an insulation distance between opposed surfaces of said two members, said insulating spacer comprising:

a plurality of unit spacers and insulating barriers clamped between adjacent unit spacers, each unit spacer having a hollow tubular shape with a peripheral portion of an insulating solid material and a hollow portion filled with an insulating medium and surrounded by the peripheral portion, said peripheral portion including a pair of side walls, said plurality of unit spacers being disposed one on top of the other between the opposed surfaces of the two members such that said side walls are staggered in a zigzag so as not to be aligned, whereby a rectilinear path extending between the opposed surfaces is not filled up with said insulating solid material only.

2. The two members and insulating spacer as set forth in claim 1, wherein the plurality of unit spacers comprise unit spacers of the same size.

3. The two members and insulating spacer as set forth in claim 1, wherein the plurality of unit spacers comprise unit spacers of different sizes.

4. The two members and insulating spacer as set forth in claim 1, wherein said insulating barriers comprise solid platelike members.

5. The two members and insulating spacer as set forth in claim 4, wherein said insulating medium consists of one of gas and an insulating oil.

6. The two members and insulating spacer as set forth in claim 4, wherein each said unit spacer has a tetragonal cross section.

* * * * *

UNITED STATES PATENT AND TRADEMARK OFFICE

CERTIFICATE OF CORRECTION

PATENT NO. : 5,130,497 Page 1 of 3

DATED : July 14, 1992

INVENTOR(S) : Toru Yoshikawa

It is certified that error appears in the above-identified patent and that said Letters Patent is hereby corrected as shown below:

The Drawing Sheets, consisting of Figs. 1-6, should be deleted to be replaced with the Drawing Sheets, consisting of Figs. 1-6, as shown on the attached pages.

Signed and Sealed this

Fifth Day of October, 1993

Bruce Lehman

*Attest:*

BRUCE LEHMAN

*Attesting Officer*

*Commissioner of Patents and Trademarks*